US007525232B2

(12) United States Patent
Latz et al.

(10) Patent No.: US 7,525,232 B2
(45) Date of Patent: Apr. 28, 2009

(54) SLIDING ELECTRICAL CONTACT PART

(75) Inventors: Wilhelm Latz, Allemagne (DE); Michel Lincker, Amiens (FR); Emmanuel Joly, Asnière/Seine (FR)

(73) Assignee: Carbone Larraine Applications Electriques (FR)

( * ) Notice: Subject to any disclaimer, the term of this patent is extended or adjusted under 35 U.S.C. 154(b) by 389 days.

(21) Appl. No.: 10/566,702

(22) PCT Filed: Jul. 26, 2004

(86) PCT No.: PCT/FR2004/001987

§ 371 (c)(1),
(2), (4) Date: Feb. 1, 2006

(87) PCT Pub. No.: WO2005/020390

PCT Pub. Date: Mar. 3, 2005

(65) Prior Publication Data

US 2007/0042650 A1 Feb. 22, 2007

(30) Foreign Application Priority Data

Aug. 1, 2003 (FR) ..... 03 09514

(51) Int. Cl.
*H01R 39/20* (2006.01)
*H01R 39/22* (2006.01)
*H01R 13/03* (2006.01)

(52) U.S. Cl. ..... 310/252; 310/248; 310/251

(58) Field of Classification Search ..... 310/248, 310/250–253

See application file for complete search history.

(56) References Cited

U.S. PATENT DOCUMENTS

| | | | | |
|---|---|---|---|---|
| 554,369 | A * | 2/1896 | Loomis | 310/248 |
| 1,093,614 | A * | 4/1914 | Gilson | 252/503 |
| 1,807,794 | A * | 6/1931 | Munday | 310/253 |
| 3,601,645 | A * | 8/1971 | Whiteheart | 310/219 |
| 5,207,504 | A * | 5/1993 | Swift et al. | 362/260 |
| 5,270,504 | A * | 12/1993 | Grohs et al. | 200/265 |
| 6,898,839 | B2 * | 5/2005 | Katoh et al. | 29/597 |
| 7,067,951 | B2 * | 6/2006 | Otani et al. | 310/248 |
| 2007/0035196 | A1 * | 2/2007 | Sidgwick | 310/249 |

FOREIGN PATENT DOCUMENTS

| | | |
|---|---|---|
| DE | 478021 | 6/1929 |
| EP | 0525222 | 2/1993 |
| FR | 1392967 | 3/1965 |
| FR | 2232847 | 1/1975 |
| GB | 1438224 | 6/1976 |

OTHER PUBLICATIONS

Uecker, A. "Lead-free carbon brushes for automotive starters" Elsevier Wear 255, pp. 1286-1290, 2003.*

* cited by examiner

*Primary Examiner*—Burton Mullins
(74) *Attorney, Agent, or Firm*—Baker, Donelson, Bearman, Caldwell & Berkowitz, PC

(57) ABSTRACT

A sliding electrical contact part is disclosed. The contact part includes a base of carbonaceous material and copper. The contact part is lead-free and contains zinc and iron-base particles having a size less than 500 μm. The contact part is particularly suitable for electrical devices which require high friction densities and friction velocities, such as motor vehicle starters with a high power-to-weight ratio.

15 Claims, 3 Drawing Sheets

SLIDING ELECTRICAL CONTACT PART

CROSS REFERENCE TO RELATED APPLICATIONS

This application is a §371 National Stage application of International Application No. PCT/FRO4/00 1987 filed Jul. 26, 2004 which claims priority to French Application No. 03/095 14 filed Aug. 1, 2003.

BACKGROUND OF THE INVENTION

1. Field of the Invention

This invention relates to sliding electrical contact parts containing carbon material, typically graphite, and a metal or metal alloy designed to increase the electrical conductivity, typically copper. The invention relates more specifically to electrical contact brushes, in particular those used in starter motors.

2. Description of Related Art

Sliding electrical contact parts may contain additives of lead or antimony, in order to provide them with good electrical damping properties, a low coefficient of friction on a contact element, such as a commutator, and performances which remain constant in time. To improve the wear resistivity performances, the application no. FR 1 392 967 suggests the use of materials containing, apart from lead, manganese (Example 1) or tin+iron mixture (Example 2).

As the addition of lead is toxic and damaging to the environment, there is a high demand for contact parts containing little or no lead or antimony. However, it is not easy to replace lead or antimony by other metals known for their lubricating properties. Consequently, the European patent application no. EP 0 525 222 teaches to replace lead or antimony by tin or zinc, by taking measures designed to separate the copper from the zinc or tin additions, in order to prevent these elements from forming alloys.

However, in electrical devices that demand high current densities and friction speeds, such as automobile starter motors with high power weight ratios (especially flat commutator starter motors), the brushes, especially if they don't contain lead, and even of they contain no zinc, do not attain the required performances, especially in terms of life time and the stability in time of their characteristics. The applicant has therefore searched for solutions to this problem.

SUMMARY OF THE INVENTION

The object of the invention is a sliding electrical contact part containing a carbon and copper base, characterised in that, free from lead, which is to say containing practically less than 0.05 weight-% of lead, it contains among others zinc as well as iron based particles, which are less than 500 μm in size.

The applicant has noted, in his tests, that the combined effect of zinc and iron was to reduce friction without causing rapid wear of the contact part. The applicant attributes the performances of the contact parts of the invention to the fact that iron has polishing properties combined with high electrical conductivity.

The iron based particles, which typically contain more than 80 weight-% of iron, may possibly contain one or more alloy elements.

The base containing carbon preferably represents at least 20 weight-% of the weight of the contact part. This proportion is typically between 30 and 80 weight-%.

The base containing carbon of the brush contains at least one material containing carbon, which may be carbon or preferably graphite. The contact part of the invention may possibly contain more than one material containing carbon, such as a mixture of graphite and amorphous carbon. Preferably, the base containing carbon will have at least 60% of its weight made up of graphite. The graphite may be natural or artificial or a mixture of both.

The proportion of iron based particles in the composition of the contact part is preferably between 1% and 15% of the weight, and still more preferably between 3% and 10% of the weight. The size of the iron based particles, typically characterised by a D50, is advantageously below 500 μm, and preferably below 200 μm; this allows on the one hand to obtain an homogenous distribution of the iron in the powder before it is compressed, and on the other hand to prevent the appearance of micro-cracks in the powder mixture after compression. It is also advantageously greater than 50 μm in order to make the powder mixture pour better prior to compression.

The proportion of zinc is preferably between 0.5 and 20 weight-%, and still more preferably between 1 and 10 weight-%.

The proportion of copper depends on the application envisaged. It is typically situated between 20 and 80 weight-%.

DETAILED DESCRIPTION OF A PREFERRED EMBODIMENT

Figure 1A:
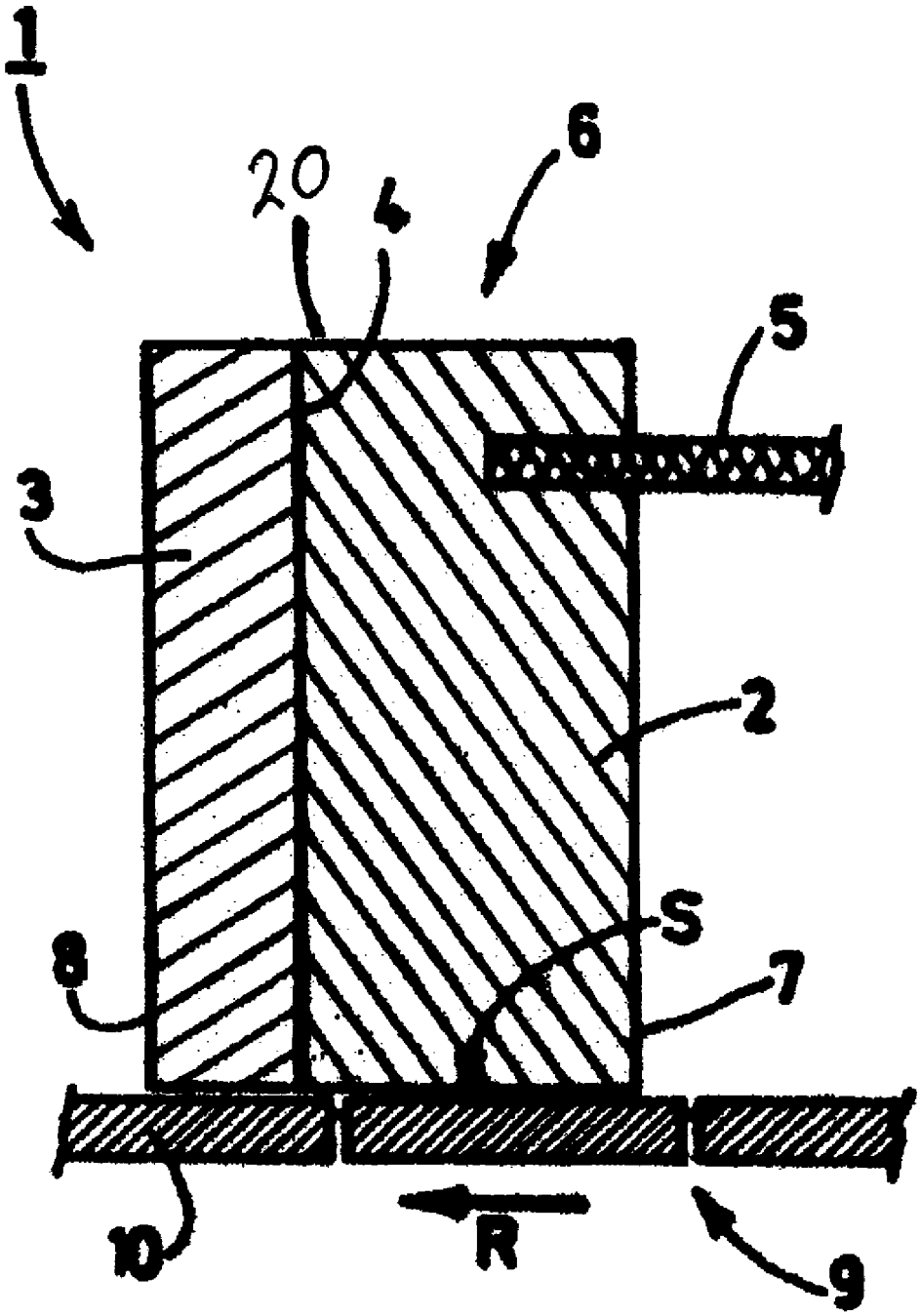
FIG. 1 shows double layer starter motor brushes of the invention in a longitudinal sectional view.

The contact part of the invention may possibly contain additives such as one or more lubricants or one or more polishing products (such as carbides or cokes).

The contact part of the invention may be formed by several stacked layers, which is to say that it may be multi-layer, for example a double layer.

The sliding electrical contact part of the invention is advantageously used in an electrical brush. In this way, an electrical brush is also an object of the invention, such as a brush for an electrical motor or starter motor comprising at least one sliding contact part according to the invention. The commutator of electrical motors and starter motors may be cylindrical or flat. The contact part of the invention is especially adapted to the brushes of automobile starter motors. The brushes according to the invention may be made of a single material (single layer) or of several materials (multi-layer), with at least one conductive layer, called the conductive layer, composed of a material with low electrical resistivity and at least one layer, called the switching layer, composed of a material with a higher electrical resistivity. In the latter case, it is at least the material composing the conductive layer that advantageously contains the zinc and iron particles whose size is less than 500 μm.

The contact parts of the invention may be obtained by a process comprising:

- the mixing of copper, zinc, iron and graphite powders and a bonding agent;
- the shaping of the contact part, typically by compression in a die;
- the heat treatment of the part capable of baking it.

The French patent application no. FR 2 709 611 describes a manufacturing process for multi-layer brushes capable of being used to obtain the brushes of the invention.

An electrical brush (1) typically comprises at least one contact part (6) and a connecting conductor (5) that is typically a flexible cable. The brush (1) may comprise means to connect the contact part (6) electrically to the connecting conductor (5).

The direction of rotation of the blades (10) of the commutator (9) is shown by the arrow R. The blades (10) "enter" from the side (7) called brush inlet and "leave" by the side (8) called brush outlet.

As shown in FIG.1, a multi-layer brush (1) comprises a contact part (6) which typically comprises a base (20) including at least one first layer (2) with a first conductivity, called high, and a second layer (3) with a second conductivity, called low. These layers are positioned so that the interface plane (4) between them intercepts the blades (10) of the commutator (9). This layout prevents electrical arcs from occurring during switching, which is to say when a blade passes from one commutator to the next. The interface is typically perpendicular to the plane that is tangential to the blades (10).

Figure 1B:
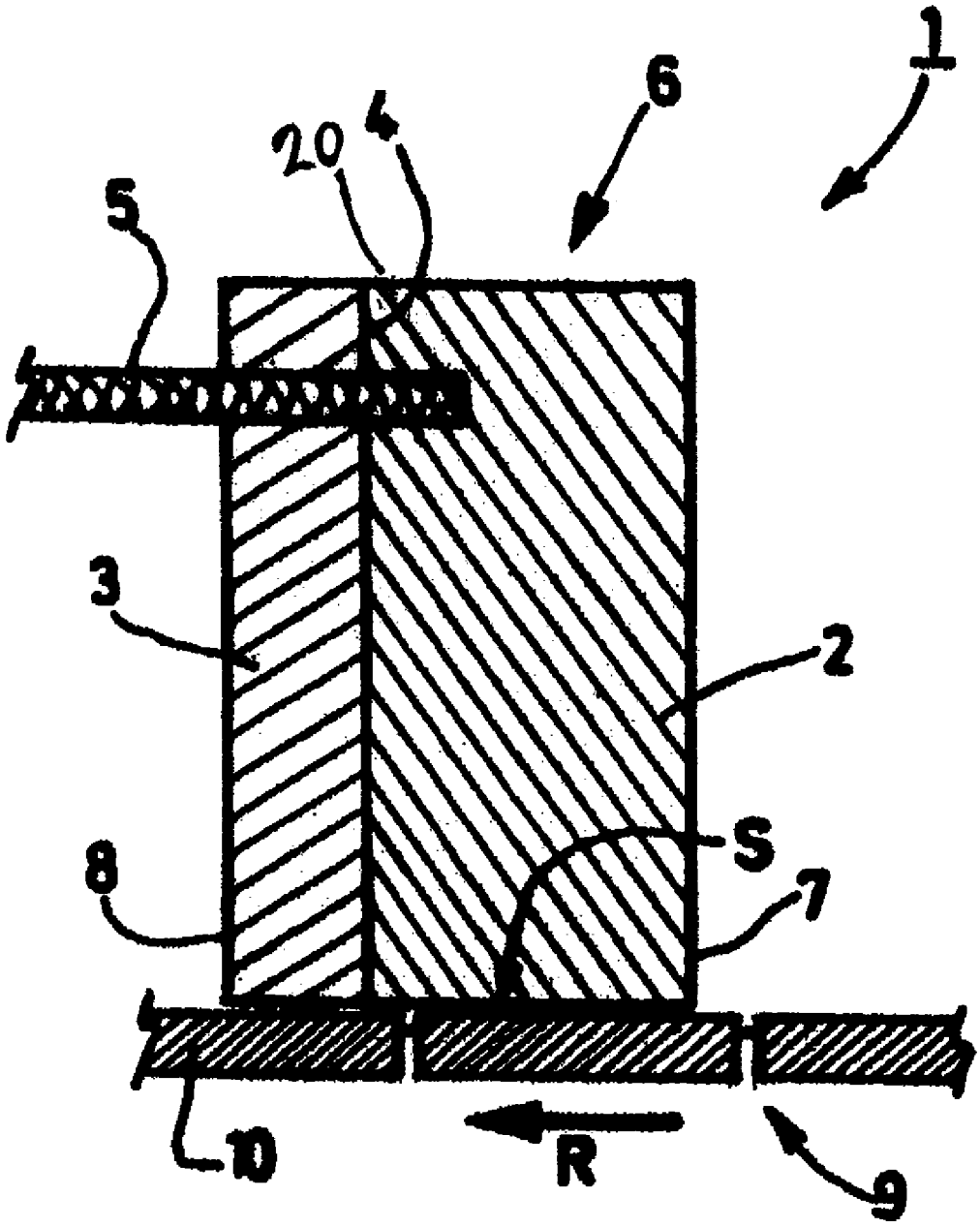
Figure 2:
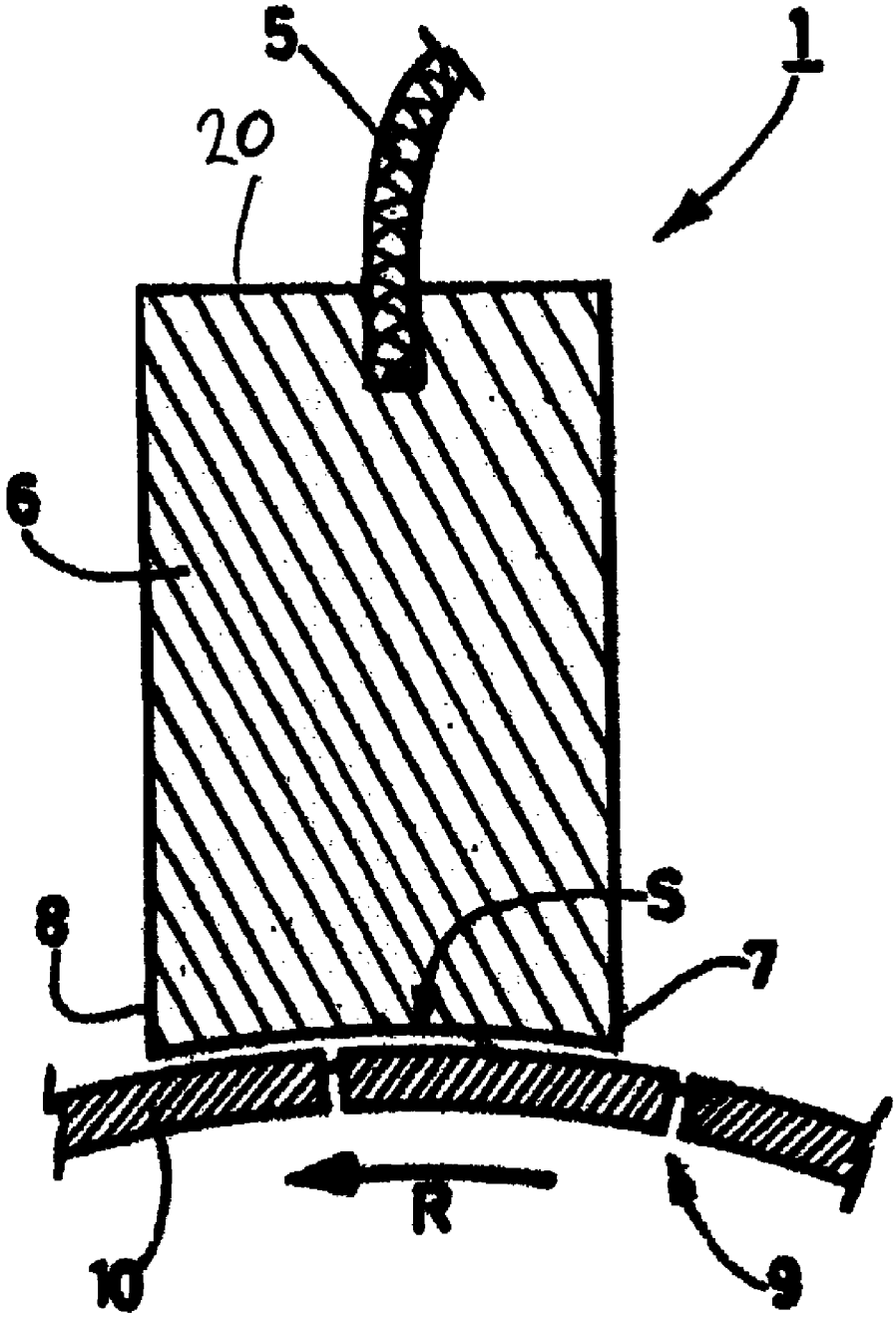
FIG. 2 shows an electrical motor brush of the invention, in a longitudinal sectional view.

In the case of a double layer starter motor brush, such as that shown in FIG. 1, the connecting conductor (5) is typically anchored in the high conductivity layer (2) of the brush, either directly (FIG. 1A) or via the low conductivity layer (3) (FIG. 1B).

The proportion of copper in the high conductivity layer is typically between 50 and 70 weight-%. It is typically between 2 and 30 weight-% in the low conductivity layer.

In the case of starter motors, the thickness of the layers depends on the type of starter motor. In automobile starter motors, the thickness of the high conductivity layer is typically between 3 and 6 mm; that of the low conductivity layer is typically between 1 mm and 2 mm.

A multi-layer brush may also comprise two or more joining contact parts.

Comparative tests were carried out on two different compositions of multi-layer brushes. The brushes were multi-layer brushes such as those shown in FIG. 1. With respect to the contact surface area S on the commutator, the dimensions of the brushes were 18 mm in the radial direction, 11 mm in the axial direction and between 4.5 mm and 9.4 mm in the tangential direction. The commutators were flat (as shown in FIG. 1).

Table I shows the ranges of the proportions in weight of each component used in the initial mixture of the first layer (2). The iron particles had a purity of metal higher than 99 weight-%. The additive consisted of usual lubricating and polishing products.

TABLE I

| | Composition | | | | |
|---|---|---|---|---|---|
| Test | Cu (%) | Zn (%) | Fe (%) | Graphite + bonding agent (%) | Additive (%) |
| No. 1 | 60 to 65 | 3 to 5 | 5 to 9 | 17 to 30 | 2 to 4 |
| No. 2 | 60 to 65 | 3 to 5 | 0 | 26 to 35 | 2 to 4 |

The composition of the second layer (3) called the switching layer was similar to the first layer with a significant difference in the proportion of copper, which was much lower in order to increase the resistivity of the layer.

Table II shows the results of the tests and measurements carried out on these brushes. This table provides, for each test, the resistivity p measured, the speed of rotation of the commutators of the flat starter motors (corresponding to that of the input gear mounted on the machine shaft), an evaluation of the wear of the contact, which is to say an evaluation of the drop in the performances after 20,000 cycles (by measuring the torque and the speed of rotation), and an evaluation of the "working life" by measuring the number of cycles carried out on a brush for it to reach a degree of wear of 10 mm.

TABLE II

| Test | P (μΩ · cm) | Speed (rpm) | Wear | Working life (cycles) |
|---|---|---|---|---|
| No. 1 | 3 to 10 | 1600 | 4% | 40,000 to 50,000 |
| No. 2 | 30 to 50 | 1580 | 10% | 15,000 to 25,000 |

These tests show a clear improvement in the performances of the brushes of the invention, which seems to be due to the presence of iron particles.

LIST OF NUMBERED REFERENCES

1. Brush
2. First layer
3. Second layer
4. Interface
5. Connecting conductor
6. Contact part
7. "Inlet" side
8. "Outlet" side
9. Commutator
10. Commutator blade

The invention claimed is:

1. A multi layered sliding electrical contact part comprising a base containing carbon, copper, zinc and iron, wherein the contact part comprises at least one layer composed of a first material with a low electrical resistivity and at least one layer composed of a second material with a higher electrical resistivity, the first material containing zinc and iron based particles of a size less than 500 μm, and wherein the iron based particles comprise between 1 and 15 weight-% of the contact part.

2. The contact part of claim 1, wherein the base represents at least 20 weight-% of the contact part.

3. The contact part of claim 1, wherein the base represents at least 60 weight-% of the contact part.

4. The contact part of claim 1, wherein the iron based particles comprise between 3 and 10 weight-% of the contact part.

5. The contact part of claim 1, wherein the iron based particles are of a size of between 50 gm and 200 gm.

6. The contact part of claim 1, wherein the iron based particles comprise more than 80% of the weight in iron.

7. The contact part of claim 1, wherein said part comprises between 0.5 and 20 weight-% of zinc.

8. The contact part of claim 1, wherein said part comprises between 1 and 10 weight-% of zinc.

9. The contact part of claim 1, wherein said part further comprises at least one lubricant.

10. The contact part of claim 1, wherein said part further comprises at least one polishing product.

11. The contact part of claim 10, wherein the polishing product is selected from the group consisting of carbides and cokes.

12. An electrical brush comprising the contact part of claim 1.

13. The electrical brush of claim 12, wherein said brush is an electrical motor brush or an automobile starter motor brush.

14. An automobile starter motor, comprising the electrical brush of claim 12.

15. An electrical motor comprising the electrical brush of claim 12.

* * * * *